US010058859B2

(12) United States Patent
Gehrig et al.

(10) Patent No.: US 10,058,859 B2
(45) Date of Patent: Aug. 28, 2018

(54) PIPETTE DEVICE HAVING A MICRO-DOSING UNIT

(71) Applicant: BRAND GMBH + CO KG, Wertheim (DE)

(72) Inventors: Steffen Gehrig, Walldürn (DE); Burkard Schaub, Eußenheim (DE); Jürgen Schraut, Rettersheim (DE)

(73) Assignee: BRAND GMBH + CO KG, Wertheim (DE)

( * ) Notice: Subject to any disclaimer, the term of this patent is extended or adjusted under 35 U.S.C. 154(b) by 115 days.

(21) Appl. No.: 14/783,867

(22) PCT Filed: Apr. 10, 2014

(86) PCT No.: PCT/EP2014/000965
§ 371 (c)(1),
(2) Date: Oct. 11, 2015

(87) PCT Pub. No.: WO2014/166635
PCT Pub. Date: Oct. 16, 2014

(65) Prior Publication Data

US 2016/0067705 A1 Mar. 10, 2016

(30) Foreign Application Priority Data

Apr. 11, 2013 (DE) ..... 20 2013 003 390 U

(51) Int. Cl.
*B01L 3/02* (2006.01)

(52) U.S. Cl.
CPC ..... *B01L 3/0237* (2013.01); *B01L 3/022* (2013.01); *B01L 3/0268* (2013.01); *B01L 2400/0478* (2013.01)

(58) Field of Classification Search
CPC ..... B01L 3/0237; B01L 3/022; B01L 2400/0478; B01L 2300/0816; B01L 3/021;
(Continued)

(56) References Cited

U.S. PATENT DOCUMENTS 5,947,167 A 9/1999 Bogen et al.
6,168,761 B1 * 1/2001 Kelly ..... B01L 3/0275 422/522
(Continued)

FOREIGN PATENT DOCUMENTS

DE 4314343 A1 11/1994
DE 10337484 B4 5/2005
(Continued)

OTHER PUBLICATIONS (English translation) Armin et al., Pipette tip, pipetting device and combination consisting of a pipette tip and pipetting device, Oct. 2000, Hamilton Bonaduz AG, pp. 1-13.*
(Continued)

*Primary Examiner* — John Fitzgerald
*Assistant Examiner* — Truong D Phan
(74) *Attorney, Agent, or Firm* — David S. Safran

(57) ABSTRACT

A pipette device having a pipette unit (1), a positioning unit (4), a micro-dosing unit (5) and a control device (6). The micro-dosing unit (5) is implemented separately from the pipette unit (1). However, it can be coupled to the pipette unit (1) in a precisely defined relative position. The pipette unit (1) thus has a coupling device (10) and the micro-dosing unit (5) has a corresponding counter-coupling device (11). One of the two devices can be switched. By switching the coupling device (10) and/or the counter-coupling device (11), the micro-dosing unit (5) can be coupled to the pipette unit (1) or decoupled from the pipette unit (1) as desired. If
(Continued)

the micro-dosing unit (5) is coupled to the pipette unit (1), it can be moved to different operating positions together with the pipette unit (1).

13 Claims, 7 Drawing Sheets

(58) Field of Classification Search
CPC ..... B01L 3/0217; B01L 3/0213; B01L 3/502; B01L 2400/0406; B01L 2300/0825; B01L 3/0265; B01L 3/0275; C40B 60/14; G01N 1/12; G01N 1/16; G01N 1/2273; G01N 35/1065; G01N 7/08; G01N 13/04; G01N 35/025; G01N 35/00029; G01N 2035/00752; G01N 7/04; B01J 19/0046; B01J 2219/00722; B67D 1/0412; B67D 7/163; B67D 1/04; B25J 17/0266; B25J 9/046; B66C 23/44
USPC ..... 73/864, 863.32, 864.11; 422/417, 521, 422/64, 501, 100, 68.1; 222/61; 414/680, 141; 436/148
See application file for complete search history.

(56) References Cited

U.S. PATENT DOCUMENTS 6,180,061 B1 1/2001 Bogen et al.
6,232,129 B1 5/2001 Wiktor
7,105,357 B1 * 9/2006 Kalkum ..... G01N 35/0098 422/521
7,900,850 B2 * 3/2011 Zengerle ..... B01L 3/0268 239/11
8,071,049 B2 * 12/2011 Koltay ..... B01L 3/0268 219/385
9,067,051 B2 6/2015 Loth et al.
2003/0000319 A1 * 1/2003 Rainin ..... B01L 3/0217 73/864.14
2005/0095723 A1 * 5/2005 DiTrolio ..... B01L 3/021 436/180
2006/0171854 A1 * 8/2006 Koltay ..... B01L 3/0268 422/400
2008/0240898 A1 10/2008 Manz et al.
2010/0196210 A1 * 8/2010 Jungheim ..... B01L 3/0275 422/526
2010/0209303 A1 * 8/2010 Tao ..... B01L 3/0275 422/523
2010/0226825 A1 * 9/2010 Beckey ..... B01L 3/0217 422/509
2011/0106280 A1 * 5/2011 Zeier ..... H01M 10/42 700/90
2011/0300621 A1 * 12/2011 Belz ..... B01L 9/543 435/287.2
2011/0306052 A1 * 12/2011 Belz ..... G01N 35/0099 435/6.12
2013/0041236 A1 * 2/2013 Pugia ..... A61B 10/0045 600/309
2013/0102501 A1 * 4/2013 Craighead ..... G01N 33/54386 506/14
2013/0327787 A1 12/2013 Koltay et al.

FOREIGN PATENT DOCUMENTS

DE 102013006227 A1 10/2014
GB 2453214 A * 4/2009 ..... G01N 35/1081
WO 2006/076957 A1 7/2006

OTHER PUBLICATIONS

A. Madjarov, W. Streule, P. Prokopp, A. Ernst, R. Zengerle and P. Koltay; Nanoliter Dispensing on Pipetting Workstations by Disposable Pipjet-Tips; Actuator 2012, 13th International Conference on New Actuators, Bremen, Germany, Jun. 18-20, 2012, pp. 430-433.
Dr.-Ing. Wolfgang Streule, Gesundheit, Pipejettip, Microtec Südwest, Actuator 2012, 13th International Conference on New Actuators, Bremen, Germany, Jun. 18-20, 2012, pp. 1-16.
Streule, W. [U.A.]: Pipejet: A Simple Disposable Dispenser for the Nano- and Microliter Range. In: J. Lab. Autom., vol. 9, 2004, NR. 5, S. 300-306. ISSN 1535-5535.
Rose, D.: Microdispensing Technologies in Drug Discovery. In: Drug Discover Today, vol. 4, 1999, NR. 9, S. 411-419.—ISSN 1359-6446.

* cited by examiner

PIPETTE DEVICE HAVING A MICRO-DOSING UNIT

BACKGROUND OF THE INVENTION

Field of the Invention

The invention relates to a pipette device having a micro-dosing unit, a pipette unit, which has at least one pipette tip which can be mounted exchangeably on the pipette unit and an expulsion end, a positioning means, and a control means.

Description of Related Art

A pipette device of the type in question may have, in principle, merely a single pipette tip at a coupling point. However, such a pipette device is usually a multi-channel pipette device, in which the pipette unit thus has a plurality of coupling points and a corresponding number of pipette tips that can be mounted at said coupling points. Such a multi-channel pipette device is often used on an automated pipetter or pipette robot.

By appropriate activation of a displacement unit in the pipette unit, which displacement unit is usually formed in the manner of a cylinder-piston arrangement, liquid can be suctioned into or expelled from the pipette tips through the discharge openings thereof.

In the case of a typical pipette device of the type in question the pipette unit is brought into different operating positions by way of a positioning means. The positioning means may be an X/Y/Z movement means. It may also be the arm of a robot, which can be moved back and forth in space, largely freely. The prior art gives various suggestions for this.

In the case of a pipette device of the type in question the pipette tips are picked up in a take-up position from a tip store, i.e., are coupled to the coupling points. The pipette unit is then moved by way of the positioning means into a liquid take-up position. In order to take up the liquid into the pipette tips, i.e., in order to aspirate said liquid, the discharge openings of the pipette tips are dipped into the liquid in corresponding vessels, for example the cells of a microtitre plate. The liquid is taken up by the effect of the displacement unit or units in the pipette unit.

If the liquid take-up is complete, the pipette unit is moved by way of the positioning means into a liquid delivery position. There, the desired liquid volume is delivered from the respective pipette tip into a target vessel, again by way of the effect of the displacement unit or units. Here, too, the vessels may again be wells of a microtitre plate.

The liquid may be delivered in greater volumes as a free-flowing jet. In the case of small volumes perhaps even contact must be made between the target vessel and the pipette tip so that the adhesion force of the liquid drop at the pipette tip can be overcome. The aforementioned boundary conditions downwardly limit the liquid volumes that can be delivered to volumes in the region of a few microliters. Metered delivery quantities in the nanoliter range thus cannot be provided. In addition, in the case of the conventional automated pipetter, there is the risk of carrying over substances already located in the target vessel.

Once the liquid has been delivered in the delivery position, a remaining volume in the pipette tips is removed from time to time. For this purpose the pipette unit is brought by way of the positioning means into an expelling position, in which the rest of the liquid in the pipette tips is then expelled, again by way of the displacement unit.

Following the delivery of the remaining liquid, the pipette unit is brought into a pipette tip discarding position. There, the pipette tips are released from the coupling points on the pipette unit by way of a tip discarding means and are discarded into a collection container.

In the prior art forming the starting point of the invention (International Patent Application Publication WO 2006/076957 A1 and corresponding U.S. Pat. No. 8,071,049), comprehensive prior art has been described concerning the question of lower minimal volumes to be delivered in the case of a pipette device of the type in question. In addition, a pipette device that enables the delivery of volumes down to the nanoliter range is described in this prior art.

In the prior art discussed here, a pipette tip is connected to a resiliently deformable tube as expulsion end on the pipette tip. This tube, at the lower end, forms the discharge opening of the pipette tip. This resiliently deformable tube may be deformed by a movable actuation means of a micro-dosing unit such that a defined liquid volume can be selectively expelled by the deformation of the tube just above the discharge opening of the pipette tip. Due to the resultant volume change inside the tube, liquid is expelled from the discharge opening of the pipette tip as free-flowing drops or as a free-flowing jet. Thus, it is possible to expel extremely small volumes in the nanoliter range. For this purpose, reference may also be made to the information in the aforementioned prior art.

In the prior art, a micro-dosing unit of the pipette device is an arrangement having clamping jaws as abutment for the movable actuation means, which itself is driven piezoelectrically. For further details, reference is also made in this regard to International Patent Application Publication WO 2005/016534 A1 for a micro-dosing unit of this type, said document disclosing details regarding the structure of such a micro-dosing unit.

In the prior art forming the starting point of the invention, the micro-dosing unit of the pipette device is located in a stationary manner in the liquid delivery position. The pipette tip must be threaded from above into the actuation means of the micro-dosing unit. The liquid within the pipette tip is drawn into the tube by capillary forces. An expulsion of liquid in small sub-volumes from a pipette tip into a plurality of different target vessels requires a movement of the target vessels relative to the pipette tips arranged in a stationary manner in the liquid delivery position.

The previously described pipette device is consequently suitable in theory for delivering extremely small volumes at different locations, but as a pipette device in practical use it can still be optimized.

SUMMARY OF THE INVENTION

The invention addresses the problem of specifying a pipette device having a micro-dosing unit designed in a practical manner.

The problem presented above is solved in the case of a pipette device having the features of described herein.

In accordance with the invention, it is relevant that the micro-dosing unit is embodied as a unit separate from the pipette unit. This means that the pipette unit can be handled and used in various relevant operating positions, in particular in the pipette tip take-up position, the liquid take-up position, but also preferably in the pipette tip discarding position and, where applicable, the expelling position for remaining liquid, similarly to a conventional pipette unit of a pipette device without micro-dosing unit. By contrast, the micro-dosing unit is coupled to the pipette unit, in a precisely defined position relative to the pipette unit, when needed, namely in the liquid delivery position.

However, instead of coupling the pipette unit to the micro-dosing unit, which is stationary in a certain liquid delivery position, as is the case in the prior art, the micro-dosing unit in accordance with the invention is coupled to the pipette unit and may then be brought jointly with the pipette unit by way of the positioning means into different operating positions, for example including a plurality of different liquid delivery positions.

In accordance with the invention, optimal boundary conditions of the pipette device are created for laboratory operation. The pipette device has a pipette unit without micro-dosing unit where the micro-dosing unit is not required. The pipette device converts into a pipette unit having a micro-dosing unit where this is necessary, namely in the case of liquid delivery. For the liquid delivery, the pipette unit may be moved freely together with its micro-dosing unit, for example, over different microtiter plates, which have been set down at different locations and which themselves do not have to be moved.

The pipette device according to the invention can, therefore, also be used for different volumes. In the case of larger volumes, the pipette device may be operated without the micro-dosing unit, possibly also with normal pipette tips without resiliently deformable expulsion ends. If it is desired to do this in the range of very small volumes, the micro-dosing unit is coupled as required to the pipette unit and may then be brought together with the pipette unit to the desired operating position.

Typical materials for a resiliently deformable expulsion end of the pipette tip include polyimide, polyamide or silicone. Typical diameters are from 0.1 to 1 mm. The resiliently deformable expulsion end may be formed integrally on the pipette tip. However, it may also be mounted on the pipette tip by adhesive bonding, injection molding, shrink fitting or press fitting. The cross section of the resiliently deformable expulsion end may have any shape, but is generally round.

Preferred embodiments and developments of the teaching of the invention will also be explained later in the course of the explanation of the preferred exemplary embodiment on the basis of the drawings.

A parallel, independent problem solution is that the displacement unit of the pipette unit is activated by way of the control means in coordination with the delivery of the liquid by way of the micro-dosing unit, such that the delivered minimal liquid volume is then directly refilled into the expulsion end of the pipette tip. Thus, there is always approximately the same pressure in the pipette tip in the expulsion end. This allows a high precision in the case of the liquid delivery with the aid of the micro-dosing unit in a plurality of stages or steps.

Reference will be made frequently hereinafter in the explanation of the invention only to the pipette tip in the singular. This also includes the provision of a plurality of pipette tips in a multi-channel pipette device. Conversely, with use of the plurality term, the validity also applies to the singular, unless this would be technically meaningless.

The particular feature of the pipette device according to the invention is also reflected in a method for operating a pipette device. In this respect, the following is true:

A method for transferring liquid using a pipette device having a pipette unit, a positioning means, a micro-dosing unit and a control means, comprising the following method steps:

a) The pipette unit is moved by way of the positioning means into a pipette tip take-up position and is lowered there with its pipette shaft vertically at the front toward a pipette tip held ready in a supporting frame, wherein the pipette tip is fitted at a coupling point on the pipette shaft.

b) The pipette unit is moved by way of the positioning means into a liquid take-up position and the pipette tip is dipped there via its discharge opening into a storage vessel filled with liquid, and here liquid is taken up into the pipette tip by the action of a displacement means in the pipette unit, which displacement means is fludically connected to the pipette tip and can generate a negative pressure and overpressure.

c) The pipette unit is moved by way of the positioning means into a coupling position.

d) In the coupling position, the pipette unit is coupled to the micro-dosing unit.

e) The pipette unit, together with the micro-dosing unit, is moved by way of the positioning means into one or many liquid delivery positions, such that the discharge opening is arranged above a target vessel, and there the micro-dosing unit is put into operation for dropwise liquid delivery, wherein, preferably, a plurality of liquid delivery positions are addressed and liquid delivery is repeated.

f) The pipette unit is moved by way of the positioning means again into the coupling position, and there the micro-dosing unit is decoupled from the pipette unit.

g) The pipette unit is moved by way of the positioning means into a pipette tip discarding position, and there the pipette tip is discarded into a collection container by way of a tip discarding means.

In a preferred method step, the pipette tip is positioned in feature d) in relation to an actuation means of the micro-dosing unit such that a lower portion of the pipette tip directly above the discharge opening always remains below the actuation device and does not contact said device.

Between method steps c) and e), the displacement means may expel liquid from the pipette tip such that the meniscus of the liquid forms at the discharge opening of the pipette tip.

In a preferred variation of the method, the micro-dosing unit is put into operation between method steps d) and e), wherein the actuation device thereof performs a movement back and forth on a tube located at the lower end of the pipette tip, said tube being arranged in front of the discharge opening, such that said tube is deformed radially resiliently and in a volume-reducing manner, in such a way that the liquid in the tube is delivered in the form of free-flowing drops or in the form of a free-flowing jet.

Within the scope of the preferred method, the micro-dosing unit preferably may be coupled to and decoupled from the pipette unit by switched coupling means, wherein a coupling means preferably is a magnetic coupling, more preferably a coupling means having an energizable permanent magnet/electromagnet.

In accordance with a preferred modification of the described method, a remaining liquid in the pipette tip may be expelled by the displacement unit between method steps e) and f), wherein this is preferably performed in a separate liquid delivery position.

In accordance with a further preferred embodiment, during method step e) or as soon as the micro-dosing unit is put into operation for liquid delivery and a liquid volume is delivered from the discharge opening of the pipette tip, the displacement unit will then feed this liquid volume directly or discontinuously as overpressure.

On account of the embodiment of the method according to the invention, said method can be used to transfer liquid of extremely small volumes, i.e., volumes up to 0.1 nl, from pipette tips held by a pipette unit from a storage vessel to one or more target vessels. The pipette tip for this purpose has a tube arranged in front of the discharge opening of said pipette tip. The coupling of the pipette tip to a pipette unit of the pipette device, the taking-up of liquid, where applicable the delivery of the remaining liquid, and the discarding of the pipette tips are performed in a manner similar to that with conventional pipette devices. The liquid is delivered in extremely small volumes in accordance with the invention by a micro-dosing unit, which, following the take-up of the liquid, is switchably coupled to the pipette unit and decoupled later.

The pipette unit is moved for this purpose by way of the positioning means into a coupling position, and there the pipette tip is moved with its tube between an abutment and an actuation device of the micro-dosing unit. The abutment is rested against the tube. In the coupling position the pipette unit is also coupled via its coupling means to the counter coupling means of the micro-dosing unit, and in the coupling position the micro-dosing unit is preferably connected for control to the control means via the pipette unit. The pipette unit is then moved with the micro-dosing unit by way of the positioning means into one or more liquid delivery positions, such that the discharge opening of the corresponding pipette tip is arranged above a target vessel, and there the micro-dosing unit is put into operation for dropwise liquid delivery. The pipette unit is then moved again by way of the positioning means into the coupling position, and there the coupling means is decoupled from the counter coupling means, the abutment is moved away from the tube into a starting position, and the micro-dosing unit is set down again.

The invention will be explained in greater detail hereinafter on the basis of drawings illustrating merely a preferred exemplary embodiment. In the drawings

DETAILED DESCRIPTION OF THE INVENTION

Figure 1:
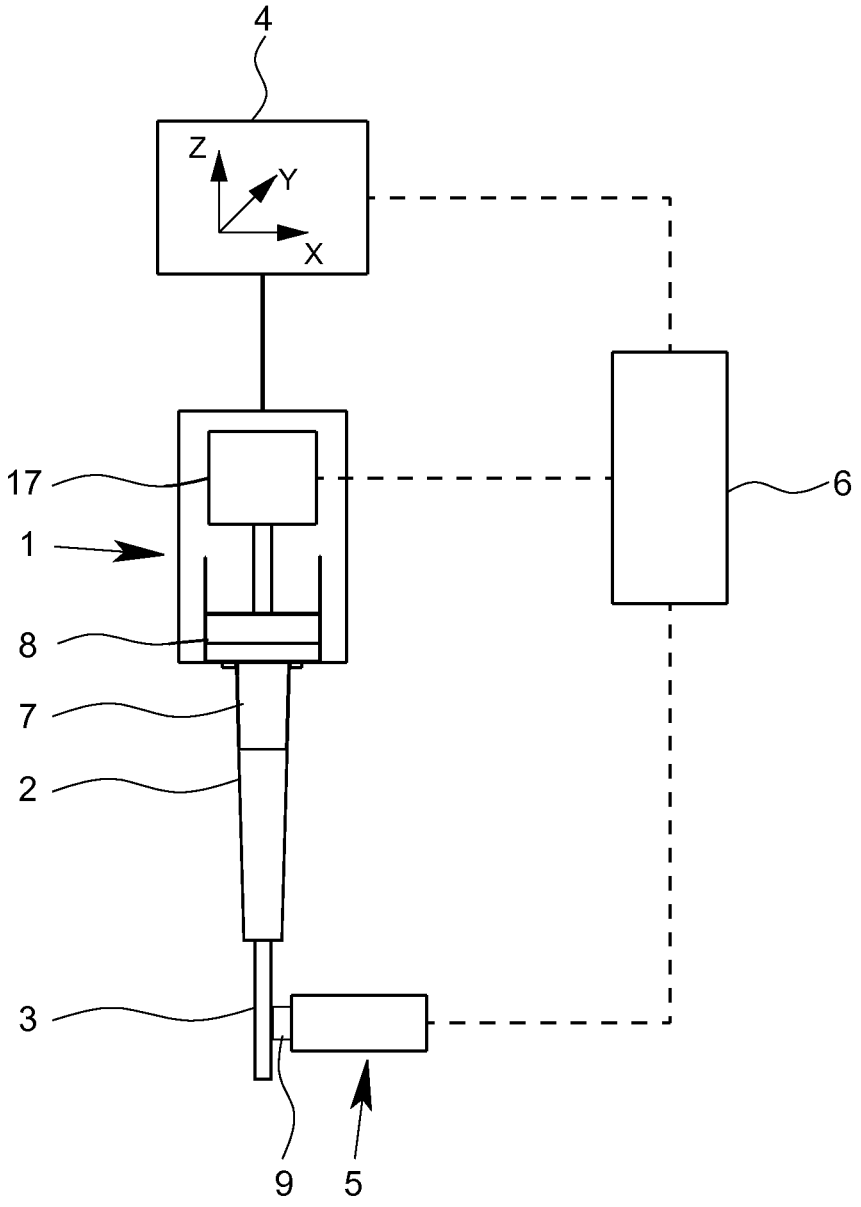
FIG. 1 shows a schematic illustration of the principle of a pipette device of the type in question.
Figure 2:
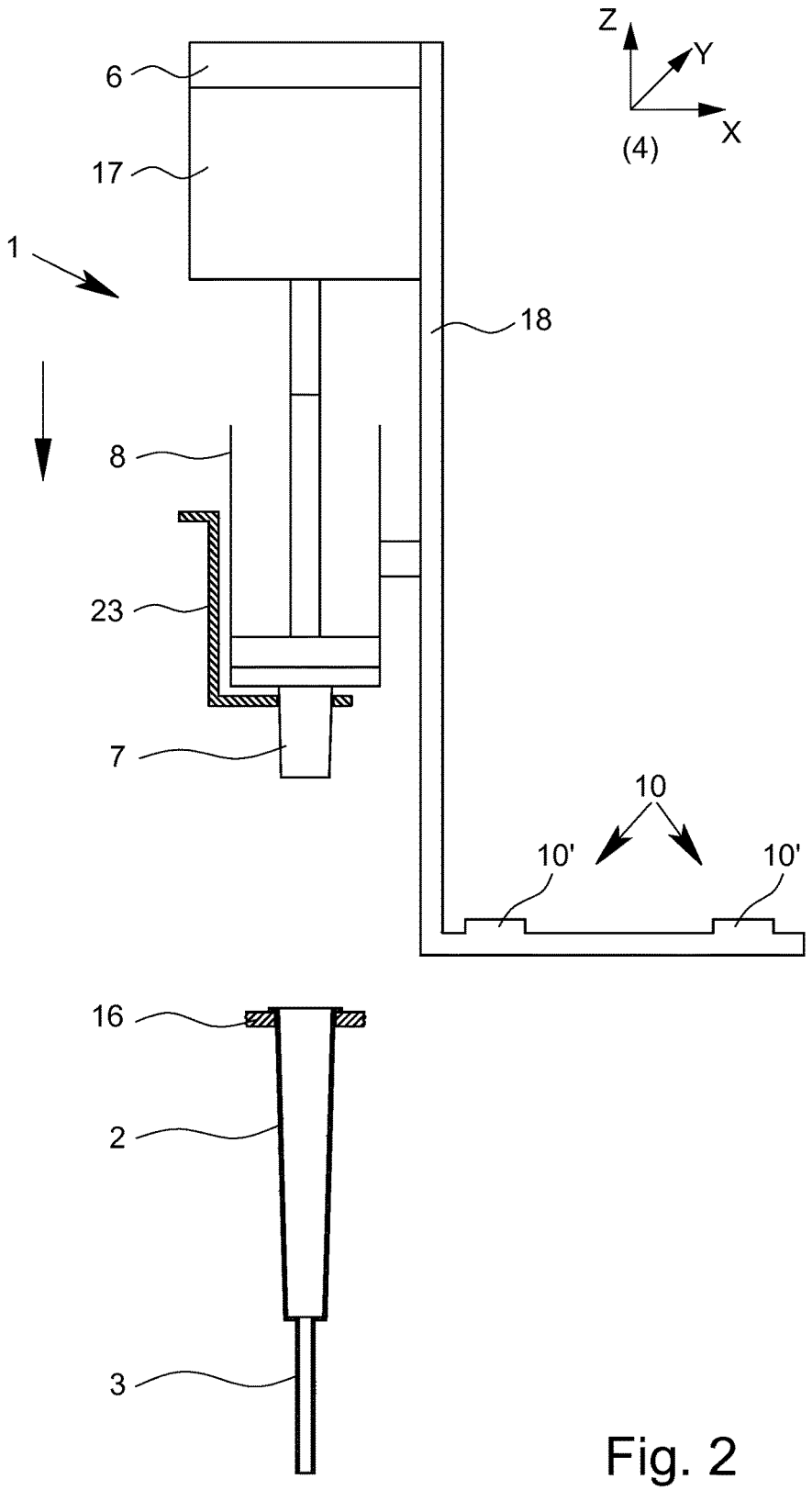
FIG. 2 shows a schematic illustration of the pipette device in a pipette tip take-up position.
Figure 7:
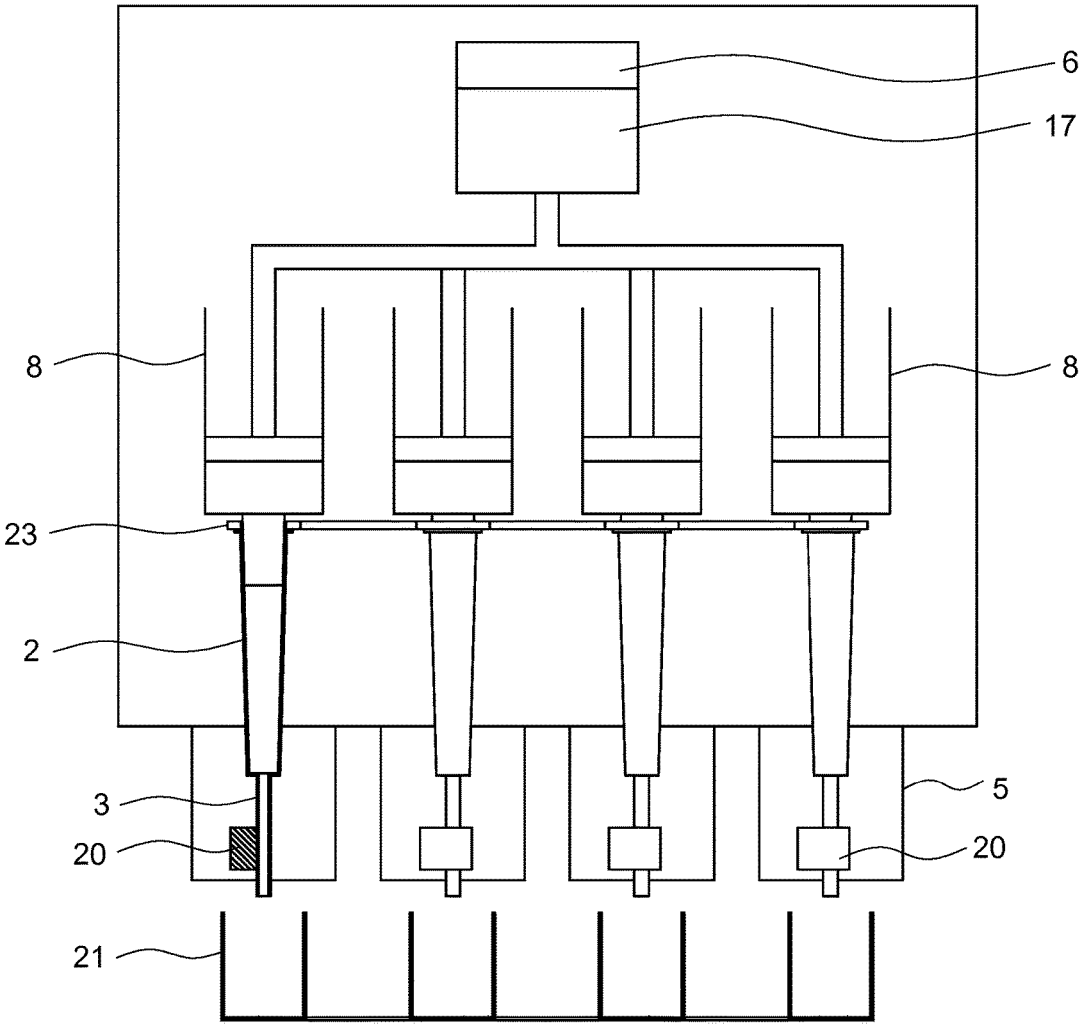
FIG. 7 shows a schematic illustration of a pipette device in accordance with the invention with four pipette tips arranged in parallel and a fourfold micro-dosing unit.

FIG. 1 shows a pipette device having a pipette unit 1. At least one pipette tip 2 can be mounted exchangeably on the pipette unit 1. In FIG. 2 or 7 it can be seen that in accordance with the preferred embodiment of the invention the pipette device is a multi-channel pipette device. Then, a plurality of pipette tips 2 are located on the pipette unit 1.

The pipette device according to the invention is preferably a pipette device having a pipette tip 2 that has a resiliently deformable expulsion end 3. The resiliently deformable expulsion end 3 in the illustrated exemplary embodiment has the form of a resiliently deformable tube. Such a tube may have an arbitrary cross section, for example, also an ellipsoidal cross section. Here, all variants are possible.

The pipette device also has a positioning means 4 and a micro-dosing unit 5. The entire pipette device is completed by an electrical, electronic, and nowadays often software-controlled control means 6, by way of which all actions of the pipette device can be controlled as desired. In FIG. 1, dashed lines indicate where transmission means for control commands, power supply and/or data are provided between the individual components of the pipette device.

As shown in FIGS. 1 and 2 in conjunction, the pipette unit 1 has a coupling point 7 for each mountable pipette tip 2. This coupling point is typically formed in the manner of a pipette shaft. The pipette tip 2 is thus fitted onto the coupling point 7 formed by the pipette shaft, or the coupling point 7 is inserted into the open upper end of the pipette tip 2 in order to couple the pipette tip 2 held ready in a holder or supporting frame 16.

The pipette unit 1 has a displacement unit 8 fluidically connected to the coupling point 7 and the pipette tip 2 mounted thereon. In the case of an air displacement pipette, the displacement unit 8 is typically a cylinder-piston arrangement. It is essential that the displacement unit 8 can generate in the coupled pipette tip 2 a negative pressure in order to take up liquid into the pipette tip 2 and can generate an overpressure in order to expel liquid from the pipette tip 2. Reference may be made in this respect also to the entire prior art explained in the introduction.

By way of the positioning means 4, the pipette unit 1 can be brought into different operating positions. Typical operating positions include a pipette tip take-up position (FIG. 2), a liquid take-up position (FIG. 3), a coupling position (FIG. 4), a liquid delivery position (FIG. 5) or a plurality of such liquid delivery positions, and a pipette tip discarding position (FIG. 6).

In between, a remaining liquid expulsion position may also be provided, which is not illustrated in the drawings. In the remaining liquid expulsion position of the pipette unit 1, remaining liquid can be removed from the pipette tips 2 before these are then discarded in the pipette tip discarding position into a container.

In the present case, the liquid delivery position(s) is/are concerned in particular.

Figure 4:
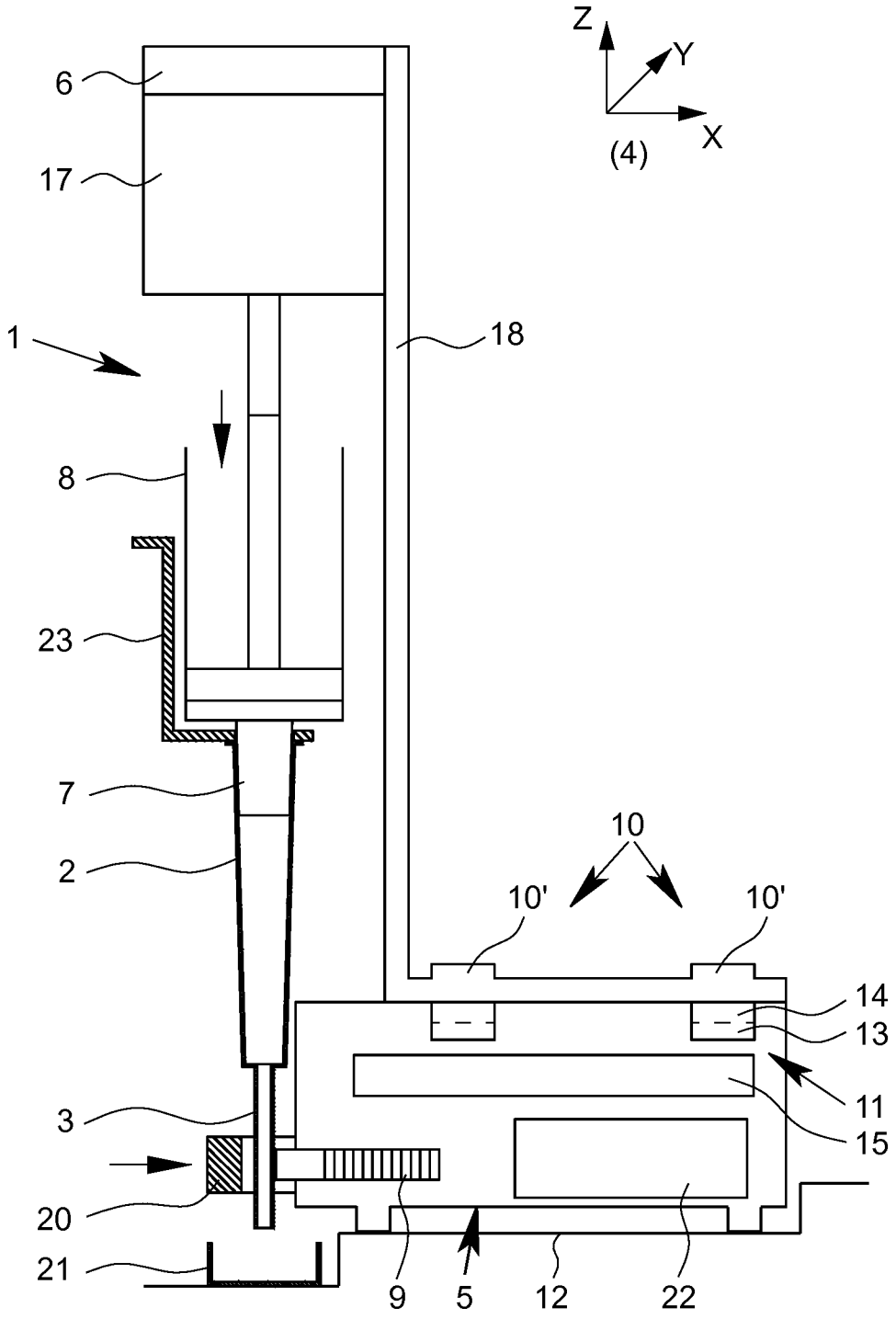
FIG. 4 shows a schematic illustration of the pipette device in a coupling position during the adjustment of the micro-dosing unit.

The micro-dosing unit 5 illustrated in FIG. 4 is activated by its own control unit 15. In order to interact with the resiliently deformable expulsion end 3, i.e., the resiliently deformable tube provided here directly above the discharge opening of the pipette tip 2, the micro-dosing unit 5 has a movable actuation means 9. The micro-dosing unit 5, as can already be seen from FIG. 1, is arranged in the delivery position of the pipette unit 1 relative to the pipette tip 2 such that the actuation means 9 is positioned at the resiliently deformable expulsion end 3 of the pipette tip 2.

Figure 5:
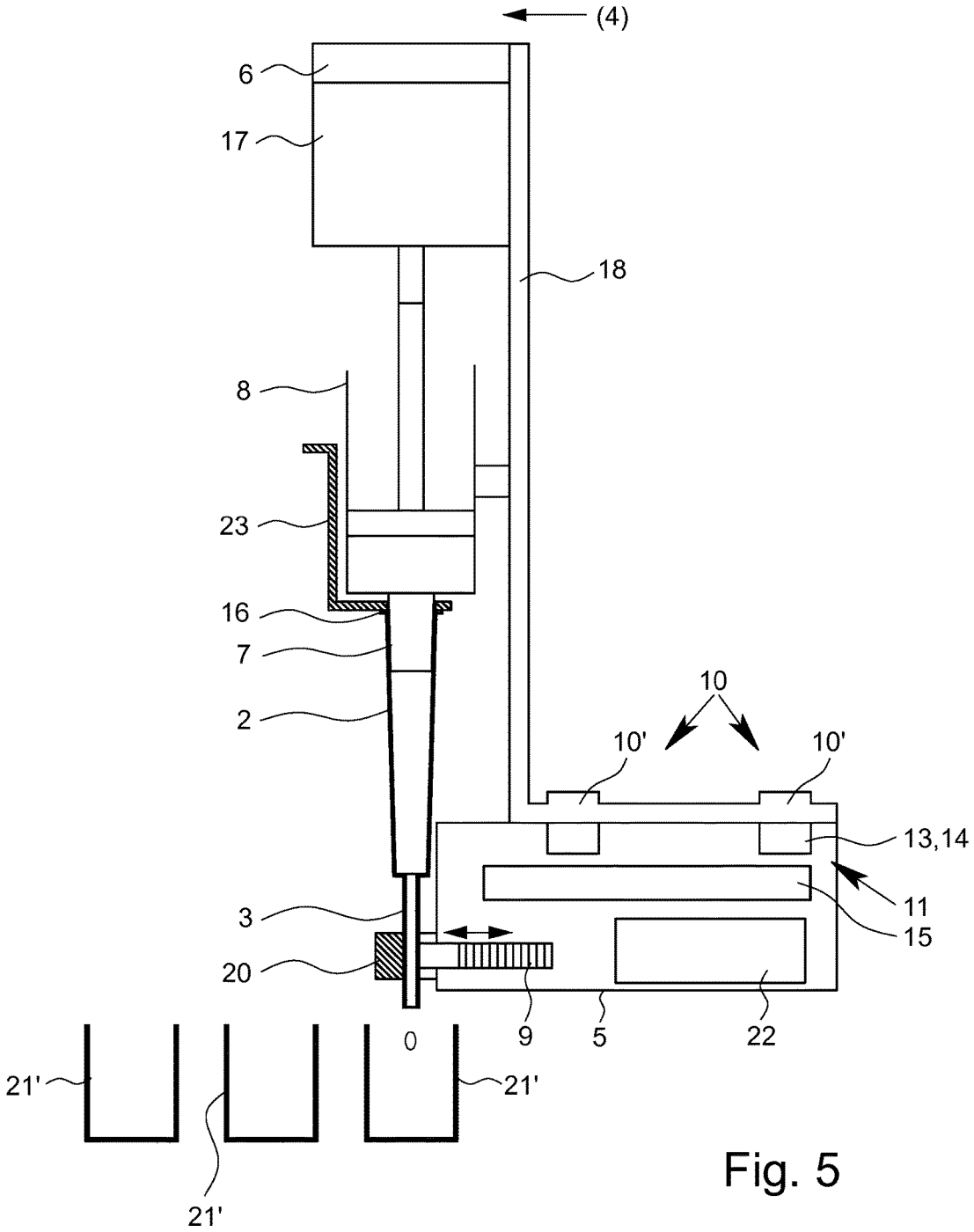
FIG. 5 shows a schematic illustration of the pipette device at the moment of liquid delivery.
Figure 6:
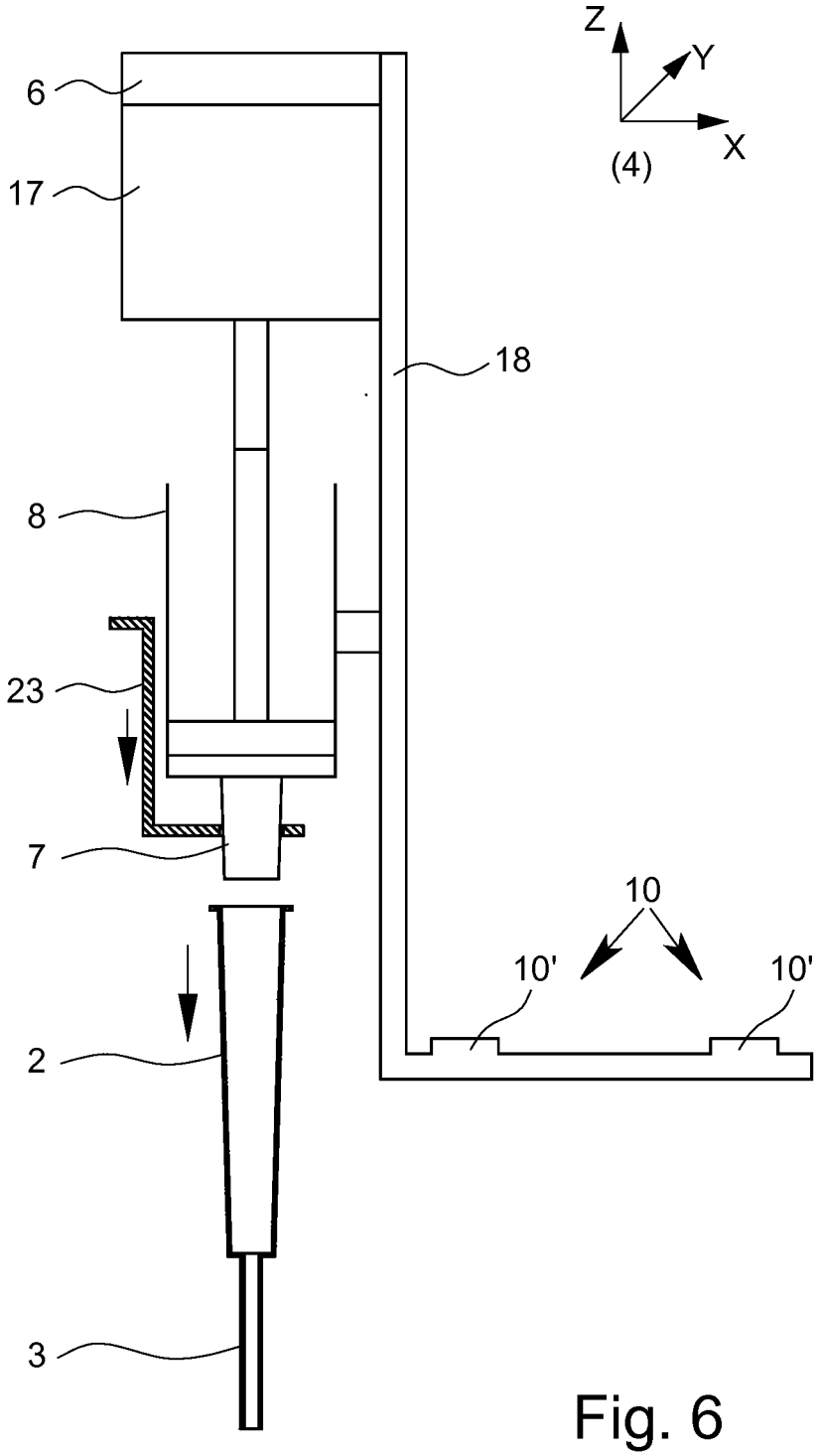
FIG. 6 shows a schematic illustration of the pipette device in a pipette tip discarding position.

In the delivery position of the pipette unit 1 shown in FIGS. 1 and 5, the expulsion end 3 of the pipette tip 2 can be deformed radially resiliently in a volume displacing manner by way of the actuation means 9 by activation of the micro-dosing unit 5. Liquid can thus be expelled once or repeatedly in the form of extremely small drops or in the form of a free-flowing jet from the expulsion end 3 of the pipette tip 2. In this way, it is therefore not the displacement unit 8 that acts to expel the liquid in extremely small volumes, but the micro-dosing unit 5, its actuation means 9 directly influencing the expulsion end 3 of the pipette tip 2, such that the volume in the expulsion end 3 reduces. The expulsion end 3 is thus deformed by way of the actuation means 9, more specifically suddenly with a strong impact, such that the liquid is expelled in the form of extremely small drops or as a short free-flowing jet. Minimal liquid quantities down to 0.1 nl thus can be expelled.

In FIGS. 2 to 7, the construction of the micro-dosing unit 5 is illustrated on the basis of the pipette unit 1. The micro-dosing unit 5 is formed to be separate from the pipette unit 1, but can be coupled selectively to the pipette unit 1 in a precisely defined relative position, the pipette unit 1 for this purpose has a coupling means 10 and the micro-dosing unit 5 has a corresponding counter coupling means 11, the coupling means 10 and/or the counter coupling means 11 can be switched, and, by switching the coupling means 10 and/or the counter coupling means 11, the micro-dosing unit 5 can be selectively coupled to the pipette unit 1 or decoupled from the pipette unit 1. The micro-dosing unit 5 therefore does not always has to be coupled to the pipette unit 1. It necessarily has to be coupled to the pipette unit 1 only when, in the liquid delivery position, extremely small liquid quantities are to be delivered into target vessels using the micro-dosing unit 5.

The advantages of the construction according to the invention of the pipette device with a separate pipette and micro-dosing units 1; 5 have been explained in the background part of the description. The particular feature of the construction according to the invention lies primarily in the fact that the micro-dosing unit 5 is coupled when necessary to the pipette unit 1 and is then entrained into the desired operating positions by this pipette unit 1, which is brought by way of the positioning means 4 into different operating positions. In particular, these positions may be different liquid delivery positions.

In FIG. 4, it can be seen that, in accordance with a particularly preferred embodiment, the pipette device has a set-down platform 12 for setting down the micro-dosing unit 5 when not in use. The set-down platform 12 provides the purposefully provided, defined space for setting down the micro-dosing unit 5 when not in use. It is expediently positioned at a stationary location in the overall pipette device. What is not illustrated in FIG. 4 is a positioning aid between the pipette device and the set down platform 12, on the one hand, and the micro-dosing unit 5, on the other hand, for the exact and stable positioning of the micro-dosing unit 5.

In principle, there are a large number of possibilities for the embodiment of the coupling means 10 and of the counter coupling means 11. In principle, it would be possible to embody the coupling means 10 and the counter coupling means 11 mechanically, i.e., as a tongue-and-groove connection or as a latched connection, etc. In principle, it would also be possible to provide a merely manual actuation. However, this would not be done normally within the scope of a pipette device operating in a largely automated manner.

It is, however, expedient when only one of the two means is active, and the other by contrast is passive. In accordance with preferred teaching, the counter coupling means 11 is active and can be switched by the control means 6 or the control unit 15, and the coupling means 10 is passive.

For the counter coupling means 11 designed specifically in accordance with the preferred exemplary embodiment, the design as a switched magnetic coupling is recommended. A switched magnetic coupling may generate a coupling effect when an electromagnet is energized.

If the switched magnetic coupling were provided in this way, the electromagnet would be energized during the entire method with the micro-dosing unit 5 on the pipette unit 1. The associated current consumption would be comparatively high.

Therefore, in a preferred design of the invention, at least one permanent magnet 13 and an electromagnet 14 associated with the permanent magnet 13 are used in the counter coupling means 11 (or the coupling means 10 for the previously mentioned alternative case). When the electromagnet 14 is not energized, the retaining force of the permanent magnet 13 couples the micro-dosing unit 5 to the pipette unit 6. In this case, the coupling means 10 has a simple counter piece 10' made of ferromagnetic material.

If the electromagnet 14 is energized with current in a direction that leads to a magnetic field directed opposite to the magnetic field of the permanent magnet 13, but approximately of identical size, the magnetic force of the permanent magnet 13 is neutralized. When the electromagnet 14 is energized, the counter coupling means 11 is thus decoupled from the coupling means 10, and the micro-dosing unit 5 is thus decoupled from the pipette unit 1.

The control of the electromagnet 14 may be further optimized, such that said electromagnet may also be energized in the opposite direction. Then, the magnetic force of the energized electromagnet 14 amplifies that of the permanent magnet 13, such that the micro-dosing unit 5 is coupled particularly fixedly to the pipette unit 1. This selective energization of the electromagnet 14 may then be implemented for example when high accelerations act on the micro-dosing unit 5 for a while or the micro-dosing unit 5 is otherwise exposed to particular forces.

A further advantage of the present construction of the preferred exemplary embodiment lies in the fact that with neutralized magnetic force of the permanent magnet 13 the pipette unit 1 can be positioned freely and easily relative to the micro-dosing unit 5 by way of the positioning means 4. Only when the defined relative position has been reached, which for example can be reached by corresponding positioning aids, will the permanent magnets 13 be released with regard to their magnetic effect.

The illustrated and preferred exemplary embodiment shows a modern, combined element formed of permanent magnet 13 and electromagnet 14. Such integrated elements are particularly compact and have a particularly high performance.

In principle, a different distribution of the components is also possible. By way of example, the counter coupling means may be embodied with energizable electromagnets, and the coupling means by contrast may be embodied with the permanent magnets, which cooperate with the electromagnets arranged opposite. This alternative is not illustrated, however, in the drawings.

It is recommended to provide a plurality of counter pieces 10', permanent magnets 13 and electromagnets 14 distributed as uniformly as possible over the surface of the pipette unit 1 and the micro-dosing unit 5, such that the micro-dosing unit 5 is suspended uniformly on the pipette unit 1.

For organization of the control structure of the pipette device according to the invention, the micro-dosing unit 5 may be connected in terms of control to the control means 6 of the pipette device, by being coupled at the pipette unit 1. Alternatively, the micro-dosing unit 5 may be self-sufficient in terms of control, wherein it communicates in a contact-based manner or wirelessly with the control means 6 of the pipette device.

Preferably, an electric contact connection is established between the pipette device and micro-dosing unit 5. Besides the communication, control signals or the voltage supply or charging currents for batteries or capacitors of the micro-dosing unit 5 may also be conducted via this contact connection. The electrical contact connection may also be arranged between the pipette unit 1 and micro-dosing unit 5 and may be connected to the coupling. In the present case the micro-dosing unit 5 has its own control unit 15, which has already been mentioned above. Suggestions for this will also be described in the further discussion of the exemplary embodiment.

The operating principle with a pipette device according to the invention will be presented again briefly hereinafter on the basis of FIGS. 2 to 6.

Figure 3:
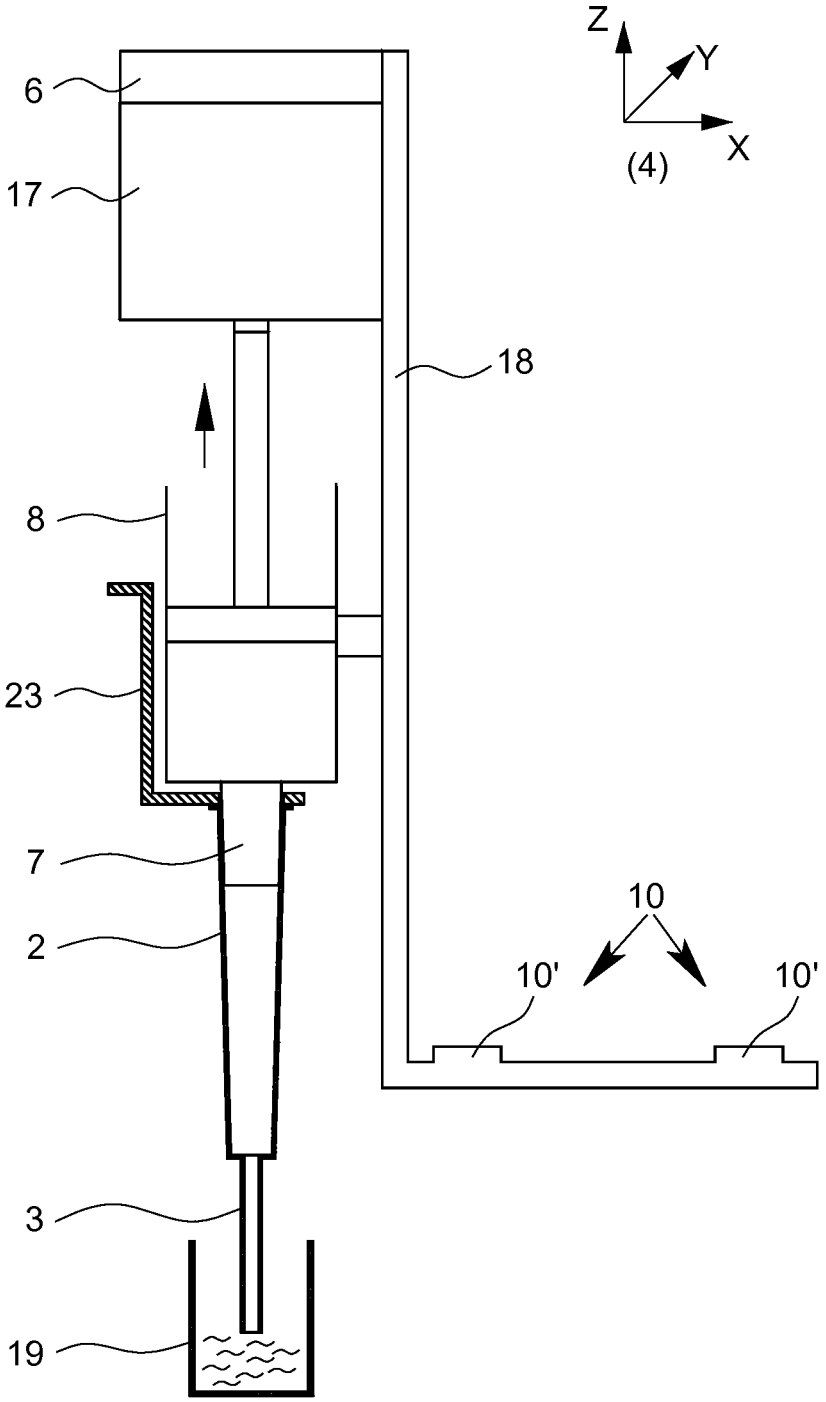
FIG. 3 shows a schematic illustration of the pipette device in a liquid take-up position.

FIG. 3 shows the situation in the pipette tip take-up position. The pipette tip 2 is hung in the supporting frame 16 of a storage container. The displacement unit 8 in the form of a cylinder-piston arrangement is located together with the associated drive 17 on a mount 18. The control means 6 of the pipette device is indicated purely schematically on the drive 17. This control means may of course also be arranged at any other point.

Arrows indicate how the pipette unit 1 illustrated here can be moved by way of the positioning means 4.

A coupling point 7 in the form of a pipette shaft, of which the conicity corresponds to the conicity of the upper end of the pipette tip 2 is located on the pipette unit 1.

In FIG. 3, the pipette tip 2 has been fitted onto the coupling point 7. The pipette unit 1 has been brought by way of the positioning means 4 into the liquid take-up position. Below, a storage vessel 19 can be seen, in which liquid is located. This has just been suctioned into the pipette tip 2 by way of the action of the displacement unit 8 in accordance with the air displacement principle. Following the suction and lifting of the pipette tip 2 from the liquid in the storage vessel 19, the piston of the displacement unit 8 can be displaced a little bit further and may suck in air for example so that in no way does any liquid drip from the discharge opening of the pipette tip 2 when the pipette unit 1 is moved to another operating position.

FIG. 4 then shows an illustration of the coupling position. Here, the pipette unit 1 has been brought together with the micro-dosing unit 5. The coupling means 10 on the pipette unit 1 interacts with the counter coupling means 11 such that the micro-dosing unit 5 is coupled fixedly to the pipette unit 1. This occurs in a defined relative position. This is necessary because the actuation means 9 of the micro-dosing unit 5 illustrated in FIG. 4 naturally must sit exactly where the expulsion end 3 of the associated pipette tip 2 is located. To the left in FIG. 4 in line with the expulsion end 3 of the pipette tip 2, a clamping jaw 20 can be seen. The arrow indicates that the clamping jaw 20 is resting against the expulsion end 3 of the pipette tip 2, such that there an abutment is provided for the movement of the actuation means 9.

In the coupling position according to FIG. 4, conditioning of the pipette unit 1 will take place. The piston of the displacement unit 8 is moved downwardly (arrow) until the meniscus of the liquid located in the discharge opening of the expulsion end 3 just forms at said opening. In FIG. 4, a vessel 21 is arranged below the discharge opening of the pipette tip 2, in which vessel there is normally not yet any liquid located. This is then to be delivered into the vessel 21. For this purpose, the micro-dosing unit 5 is put into operation. With a movement of the actuation means 9 back and forth, radial force is exerted onto the expulsion end 3 of the pipette tip formed as a resiliently deformable tube, such that it is deformed. Liquid is thus delivered in drop form from the discharge opening of the pipette tip 2 into the vessel 21. The movement of the actuation means 9 is indicated in FIG. 5 by a double-headed arrow. The movement is performed back and forth with respect to the clamping jaw 20 forming the abutment. This is the initial conditioning of the pipette device in preparation of the actual liquid delivery.

FIG. 5 then shows the actual liquid delivery in the liquid delivery position. Here, a plurality of target vessels 21' can be seen, for example the wells of a microtitre plate, and thereabove the movement direction of the pipette unit 1 together with the micro-dosing unit 5, moved by the positioning means 4 can be seen. A small liquid drop discharged from the expulsion end 3 of the pipette tip 2 by the deformation action of the actuation means 9 of the micro-dosing unit 5 is illustrated and for example has a volume of 0.5 nl.

With regard to design, it is expedient if a further feature of the invention is provided in accordance with the displacement unit 8 of the pipette unit 1 can be activated by the control means 6 in coordination with the delivery of liquid by way of the micro-dosing unit 5 such that the delivered minimal liquid volume is then refilled discontinuously or directly into the expulsion end 3 of the pipette tip 2 following a number of liquid deliveries. The pressure in the air cushion in the pipette tip 2 is thus held constant. This action of the pipette device according to the invention is also illustrated in FIG. 5. The relatively short path of movement of the piston of the displacement unit 8 can be seen by way of the arrow. After the pipetting process, the micro-dosing unit 5 is first set down again on its set-down platform 12 in the coupling position, the clamping jaw 20 is moved away from the expulsion end 3 into the starting position, and the coupling means 10; 11 are released. By way of example the batteries 22 indicated in the micro-dosing unit 5 are automatically recharged on the set-down platform 12. For this purpose, a contact-based electrical connection for the charging current and/or for a data exchange with the control means 6 is located between the micro-dosing unit 5 and the set-down platform 12.

In FIG. 6, the end position of the pipette unit 1 after a completed pipetting process is illustrated. The pipette unit 1 is again separate and has been brought as such by way of the positioning means 4 into the pipette tip discarding position. By way of the tip discarding means 23, the pipette tip 2 is discarded into a collection container. This collection container is not illustrated here. The vertical arrows in FIG. 6 indicate the courses of movement of the tip discarding means 23 and consequently of the pipette tip 2.

In the illustration of FIGS. 4 & 5, it can lastly be seen that a particular structural design has been selected, in which the pipette tip 2 is arranged relative to the actuation means 9 of the micro-dosing unit 5 at all times such that the lower portion of the expulsion end 3 of the pipette tip 2 is always located below the actuation means 9 and does not contact same. In order to ensure this also when introducing the pipette tip 2 into the micro-dosing unit 5 or into the actuation means 9 thereof, this introduction is performed in accordance with the invention not from above (as in the prior art), but through a lateral introduction opening in the actuation means 9 or laterally at the clamping jaw 20.

Liquid is aspirated into the pipette tip 2 always only with a shallow immersion of the lower end of the pipette tip 2 into a liquid store. Only the lower end in the vicinity of the discharge opening of the pipette tip 2 is wetted. In accordance with the invention, the construction is arranged such that this lower end, the lower end of the expulsion end 3 of the pipette tip 2, does not at any point come into contact with the micro-dosing unit 5. A carrying over of liquids between different target vessels 21' is therefore reliably avoided.

FIG. 7 shows details of a pipette device having a plurality of pipette tips 2, specifically four pipette tips 2, and having a plurality of displacement units 8, specifically a cylinder-piston arrangement per coupling point 7 with pipette tip 2. The piston rods of the cylinder-piston arrangements, which form the displacement unit 8, are brought together at a common drive 17. At the bottom the clamping jaws 20 and the target vessels 21 can be seen.

The invention claimed is:

1. A pipette device, comprising:

a pipette unit, at least one pipette tip having an expulsion end, a positioning means, a micro-dosing unit, and a control means, wherein the pipette unit has at least one coupling point in the form of a pipette shaft, the pipette tip being exchangeably mounted thereon, wherein the pipette unit has a displacement unit formed as a cylinder-piston arrangement, fluidically connected to the coupling point, wherein the pipette unit, by way of the positioning means, is movable into different operating positions, wherein the micro-dosing unit is separable from the pipette unit, wherein the micro-dosing unit has a movable actuation means and, at least in the delivery position of the pipette unit, is arranged relative to the pipette tip such that the actuation means is positioned at the expulsion end of the pipette tip, wherein, in a delivery position of the pipette unit, the expulsion end of the pipette tip is influenced by way of the actuation means by activation of the micro-dosing unit, such that liquid is expelled from the expulsion end of the pipette tip once or repeatedly as extremely small drops or as a free-flowing jet, wherein the pipette unit has a coupling means and the micro-dosing unit has a corresponding counter coupling means, wherein at least one of the coupling means and the counter coupling means is switchable, wherein, by switching the at least one of the coupling means and the counter coupling means, the micro-dosing unit is selectively coupleable to the pipette unit or decoupleable from the pipette unit, wherein one of the coupling means and the counter coupling means is formed as a switched magnetic coupling having at least one permanent magnet and an electromagnet associated with the permanent magnet and energizable for switching, and wherein one of the coupling means and the counter coupling means is passive, and is embodied as a ferromagnetic counter piece, wherein, when the electromagnet is de-energized, the retaining force of the permanent magnet couples the micro-dosing unit to the pipette unit, and wherein the micro-dosing unit, when coupled to the pipette unit, is moveable jointly with the pipette unit into different operating positions.

2. The pipette device as claimed in claim 1, wherein the expulsion end of the pipette tip is formed as a resiliently deformable tube and is radially resiliently deformable in a volume-displacing manner by way of the actuation means.

3. The pipette device as claimed in claim 1, wherein a set-down platform for setting down the micro-dosing unit when not in use is provided.

4. The pipette device as claimed in claim 1, wherein the counter coupling means is active and switchable and the coupling means is passive.

5. The pipette device as claimed in claim 1, wherein the pipette unit and/or the micro-dosing unit have/has positioning aids for holding the defined relative position.

6. The pipette device as claimed in claim 1, wherein the pipette unit is a multi-channel pipette unit and has a plurality of coupling points for mounting a plurality of pipette tips.

7. The pipette device as claimed in claim 6, wherein for each coupling point, a displacement unit is provided or a single displacement unit is provided jointly for all coupling points.

8. A pipette device comprising a pipette unit, at least one pipette tip having an expulsion end, a positioning means, a micro-dosing unit, and a control means, wherein the pipette unit has at least one coupling point in the form of a pipette shaft, the pipette tip being exchangeably mounted thereon, wherein the pipette unit has a displacement unit formed as a cylinder-piston arrangement, fluidically connected to the coupling point wherein the pipette unit, by way of the positioning means, is moveable into different operating positions, wherein the micro-dosing unit is separable form the pipette unit, wherein the micro-dosing unit has a movable actuation means and, at least in the delivery position of the pipette unit is arranged relative to the pipette tip such that the actuation means is positioned at the expulsion end of the pipette tip, wherein, in a delivery position of the pipette unit, the expulsion end of the pipette tip is influenced by way of the actuation means by activation of the micro-dosing unit, such that liquid is expelled from the expulsion end of the pipette tip once or repeatedly as extremely small drops or as a free-flowing jet, wherein the pipette unit has a coupling means and the micro-dosing unit has a corresponding counter coupling means, wherein at least one of the coupling means and the counter coupling means is switchable, wherein, by switching the at least one of the coupling means and the counter coupling means, the micro-dosing unit is selectively coupleable to the pipette unit or decoupleable from the pipette unit, wherein the micro-dosing unit, when coupled to the pipette unit, is moveable jointly with the pipette unit into different operating positions, and wherein, in coordination with the expelling of liquid by activation of the micro-dosing unit, the control means causes the displacement unit of the pipette unit to refill the delivered liquid volume into the expulsion end of the pipette tip so as to cause an air cushion in the pipette tip to be held at a constant pressure.

9. A method for transferring liquid using a pipette device having a pipette unit, a positioning means, a micro-dosing unit, a magnetic coupling means and a control means, comprising:

a) moving the pipette unit is moved with the positioning means into a pipette tip take-up position, and in the take-up position, lowering a pipette shaft vertically toward a pipette tip held ready in a supporting frame of as to fit the pipette tip at a coupling point on the pipette shaft, b) moving the pipette unit with the positioning means into a liquid take-up position, in the liquid take-up position, dipping a discharge opening of the pipette tip into a storage vessel filled with liquid, and taking liquid into the pipette tip by the action of a displacement means in the pipette unit, which displacement means is fluidically connected to the pipette tip and generates a negative pressure and overpressure, c) moving the pipette unit with the positioning means into a coupling position, d) in the coupling position, de-energizing the magnetic coupling means for coupling the pipette unit to the micro-dosing unit, e) moving the pipette unit, together with the micro-dosing unit, with the positioning means into at least one liquid delivery position, such that the discharge opening is arranged above a target vessel in the at least one liquid delivery position, and there, operating the micro-dosing unit to drop-wise deliver liquid from the discharge opening into the target vessel, f) moving the pipette unit with the positioning means again into the coupling position at which the micro-dosing unit is decoupled from the pipette unit by energizing the magnetic coupling means, and g) moving the pipette unit with the positioning means into a pipette tip discarding position, at which the pipette tip is discarded into a collection container by way of a tip discarding means.

10. The method of claim 9, wherein, in the coupling positioned, the pipette unit is positioned in relation to an actuation means of the micro-dosing unit such that a lower portion of the pipette tip directly above the discharge opening always remains below the actuation device and out of contact with said actuation means.

11. The method of claim 9, wherein the micro-dosing unit is operated between steps d) and e), wherein an actuation means of said micro-dosing unit performs a movement back and forth on a tube located at the lower end of the pipette tip, said tube being arranged in front of the discharge opening, such that said tube is deformed radially resiliently and in a volume-reducing manner that delivers the liquid in the tube in the form of free-flowing drops or in the form of a free-flowing jet.

12. The method of claim 9, wherein liquid remaining in the pipette tip is expelled by the displacement unit between steps e) and f) in a separate liquid delivery position.

13. The method of claim 9, wherein, during step e) a liquid volume is delivered from the discharge opening of the pipette tip by the displacement unit by overpressure.

* * * * *